US005630662A

United States Patent [19]

Ooms

[11] Patent Number: 5,630,662

[45] Date of Patent: May 20, 1997

[54] CAPPED ELECTRIC LAMP

[75] Inventor: Pieter C. Ooms, Terneuzen, Netherlands

[73] Assignee: U.S. Philips Corporation, New York, N.Y.

[21] Appl. No.: 653,931

[22] Filed: May 22, 1996

[30] Foreign Application Priority Data

May 24, 1995 [EP] European Pat. Off. ..... 95201371
Dec. 7, 1995 [EP] European Pat. Off. ..... 95203381

[51] Int. Cl.[6] ..... F21S 1/10

[52] U.S. Cl. ..... 362/363; 313/318.08

[58] Field of Search ..... 362/363; 313/318.08, 313/318.1, 318.12

[56] References Cited

U.S. PATENT DOCUMENTS 4,363,083 12/1982 Tanaka et al. ..... 362/363

*Primary Examiner*—Carroll B. Dority

*Attorney, Agent, or Firm*—Edward Blocker

[57] ABSTRACT

A capped electric lamp according to the invention comprises a lamp vessel (10) which is closed in a gastight manner and encloses a light source. The lamp vessel (10) is surrounded by a glass outer envelope (20) which is fastened at an end portion (21) to a housing (40) by means of a coupling member (30), which housing in addition supports a lamp cap (50). The coupling member (30) is made of metal, and the end portion (21) of the outer envelope (20) is fused to the coupling member (30). In the lamp according to the invention, the coupling member (30) is of a simple construction while nevertheless a blown outer envelope (20) can be used.

4 Claims, 2 Drawing Sheets

CAPPED ELECTRIC LAMP

BACKGROUND OF THE INVENTION

The invention relates to a capped electric lamp comprising a lamp vessel which is closed in a gastight manner, encloses a light source, and is surrounded by a glass outer envelope which at an end portion is fastened to a housing by means of a coupling member, which housing also supports a lamp cap.

The glass outer envelope of a lamp of the kind mentioned in the opening paragraph is usually manufactured in a moulding process. The moulding process admits of a comparatively wide freedom as to the shape of the product to be manufactured. The outer envelope may be shaped such that an optimum fastening to the coupling member is possible. The other side of the medal is that an outer envelope of comparatively small wall thickness and thus low weight can be readily manufactured in a blowing process. This renders a blown outer envelope attractive, in particular for compact fluorescent lamps.

A lamp of the kind described in the opening paragraph is known from EP 210 361. The known lamp is a compact fluorescent lamp in which a discharge vessel bent into a compact shape is arranged in the outer envelope. The coupling member, which is made of synthetic resin, is provided with hooks which extend radially outward and are accommodated in the outer envelope. The hooks each grip behind a major constriction of the outer envelope, so that the hooks of the coupling member and the constriction of the outer envelope together form an interlocking connection. An outer bulb having a shape which can also be obtained in a blowing process can suffice in the known lamp. A disadvantage is, however, that the coupling member has a comparatively complicated construction.

SUMMARY OF THE INVENTION

It is an object of the invention to provide a lamp of the kind described in the opening paragraph which renders possible a simpler construction of the coupling member, while nevertheless a blown outer envelope can be used.

According to the invention, the lamp of the kind described in the opening paragraph is for this purpose characterized in that the coupling member is made of metal, and the end portion of the outer envelope is fused to the coupling member. This results in a connection between the outer envelope and the coupling member without play. Both the outer envelope and the coupling member may have a simple shape, in contrast to the case of a connection based on interlocking shapes.

The coupling member may comprise a metal having a coefficient of expansion which corresponds to that of the glass of the outer envelope, for example in the case of lime glass, a CrNiFe alloy, for example Cr 6%, Ni 42%, remainder Fe (by weight). Given a hard-glass outer envelope, for example borosilicate glass, a rim, for example, of Ni/Fe or of NiCoFe, for example Ni 29%, Co 17% remainder Fe (by weight) may be used.

The housing may be manufactured from a synthetic resin such as polybutylene terephtalate, polycarbonate, or polysulfon.

The coupling member may comprise separate metal strips to each of which the outer envelope is fused. A favorable embodiment of the lamp according to the invention, however, is characterized in that the coupling member is a ring. A coupling member is thus realized with a single component which is of a sturdy construction.

An attractive embodiment of the lamp according to the invention is characterized in that the end portion of the outer envelope is fused to an annular zone of the ring which widens in a direction from the outer envelope to the lamp cap. The outer envelope readily allows itself to be fixed to the metal ring during lamp manufacture, and the relevant components automatically assume mutually concentric positions.

The ring may be fastened to the housing, for example, with cement. An advantageous embodiment of the lamp according to the invention is characterized in that the ring has one or several edge portions around the annular zone which extend obliquely outwards away from the lamp cap and which cooperate with one or several thickened portions of the housing which project inwards. This embodiment of the lamp according to the invention is comparatively easy to manufacture. The coupling member with the outer envelope may be readily fastened to the housing in that the coupling member is pressed into the housing. Since the edge portions of the ring extend away from the lamp cap, they can easily pass the thickened portions of the housing. After the edge portions have passed the thickened portions, they hook themselves behind the latter so that the coupling member, and thus the discharge vessel, is securely fastened to the housing.

The one or several thickened portions of the housing which projects inwards are formed, for example, by a circumferential rim which projects inwards. Alternatively, for example, the thickened portions may be constructed as projections. The one or several edge portions of the ring extending obliquely outwards may be tongues. Alternatively, the edge portion may be a further annular zone in the form of a truncated cone. The further annular zone may, for example, merge directly into the annular zone mentioned earlier, or may alternatively merge into it via an annular transition zone.

The light source in the lamp vessel may be, for example, an incandescent body which is arranged, for example, in an inert gas such as nitrogen or a rare gas. The lamp vessel may comprise, for example, a halogen such as bromine. In an embodiment, the light source is an ionizable medium which is brought into a discharge state during lamp operation, for example by means of a pair of electrodes or a winding of an electrical conductor. The ionizable medium may comprise besides an inert gas, for example, a component capable of evaporation, such as mercury.

The glass outer envelope may be frosted so as to scatter the light of the light source, for example, in that it is etched or provided with a powder layer. The outer envelope may, for example, have a luminescent layer at an inner surface, for example if the light source is a UV source. Alternatively, the outer envelope may be, for example, transparent and act exclusively as a thermal insulator. This may be important for lamps which are used in cold surroundings. In an embodiment, the outer envelope may be provided with a reflecting layer over part of its surface area.

BRIEF DESCRIPTION OF THE DRAWINGS

These and other aspects of the capped electric lamp according to the invention will be explained in more detail with reference to a drawing, in which.

DETAILED DESCRIPTION OF THE PREFERRED EMBODIMENT

Figure 1:
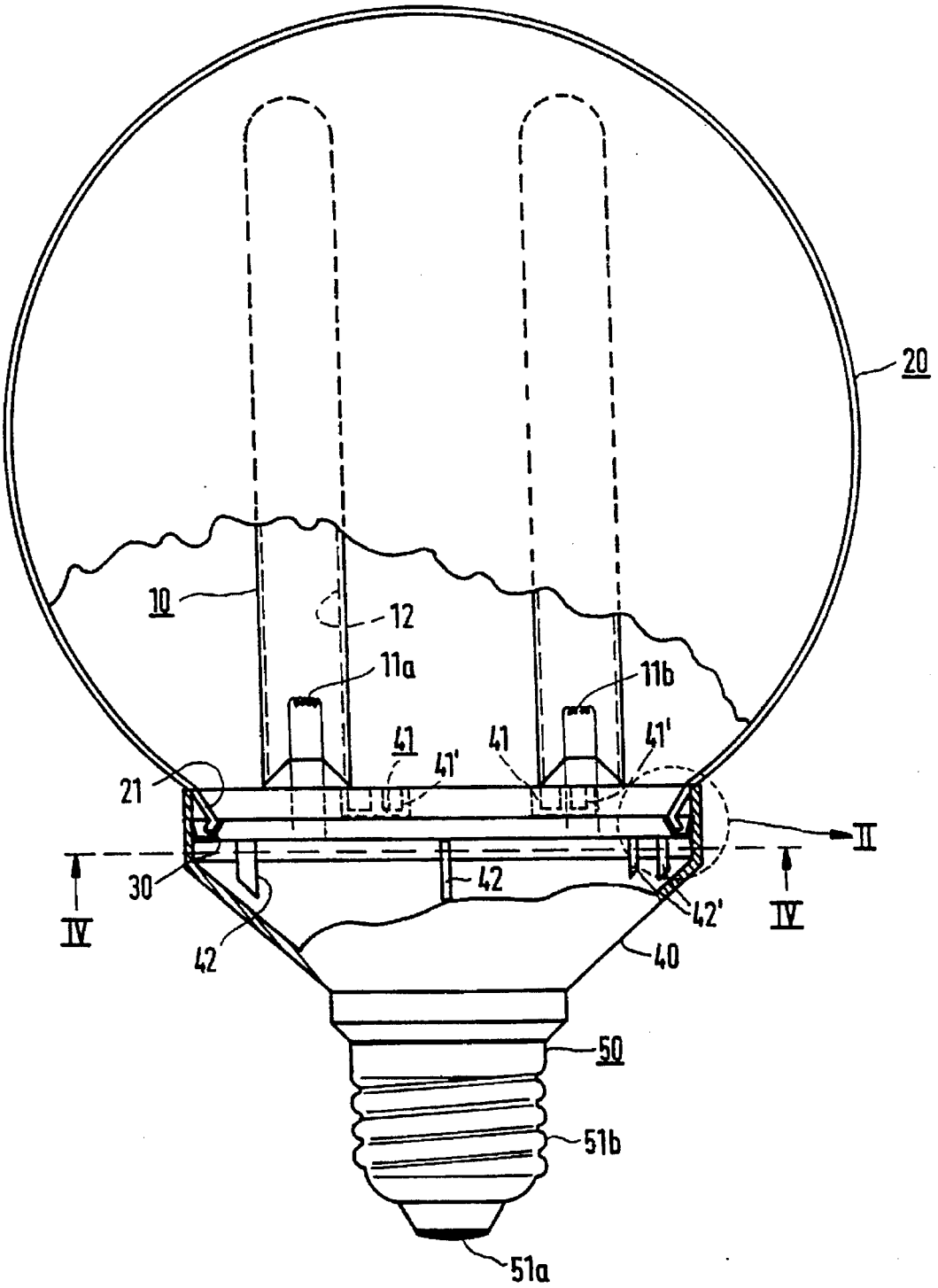
FIG. 1 shows an embodiment partly in elevation and partly in longitudinal sectional view.
Figure 2:
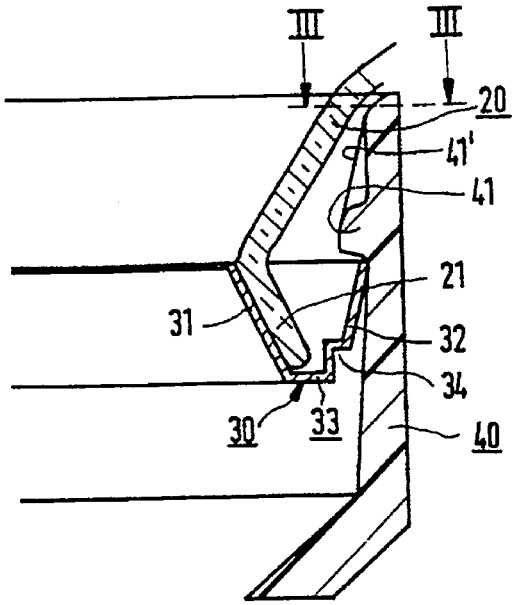
FIG. 2 shows a detail II from FIG. 1.

The capped electric lamp shown in FIG. 1 comprises a lamp vessel 10 which is closed in a gastight manner and encloses a light source. The lamp vessel 10 here is a tubular lamp vessel bent into a hook shape. The light source in the lamp vessel 10 is an ionizable medium in which a gas discharge is generated by a pair of electrodes 11*a*, 11*b* during operation. The lamp vessel 10 here has a filling mercury and a rare gas and is provided at an inner surface with a luminescent layer 12, shown in broken lines. The lamp vessel 10 is surrounded by a blown glass outer envelope 20 which is fastened at an and portion 21 to a housing 40 by means of a coupling member 30, which housing in addition supports a lamp cap 50. A detail (indicated with II in FIG. 1) of the fastening of the outer bulb 20 to the housing 40 by means of the coupling member 30 is shown on an enlarged scale in FIG. 2. A supply unit (not shown) for the light source is accommodated in the housing 40 and connected to electrical contacts 51*a*, 51*b* of the lamp cap 50.

The coupling member 30 is made of metal. The end portion 21 of the outer envelope 20 is fused to the metal coupling member 30. In the embodiment shown, the outer envelope 20 is made of lime glass and the coupling member 30 of an CrNIFe alloy, in this case Cr 6%, Ni 42%, remainder Fe (by weight).

In the embodiment shown, the coupling member 30 is a ring, and the end portion 21 of the outer envelope 20 is fused to an annular zone 31 of the ring 30 which widens in a direction away from the outer envelope 20 to the lamp cap 50.

Figure 3:
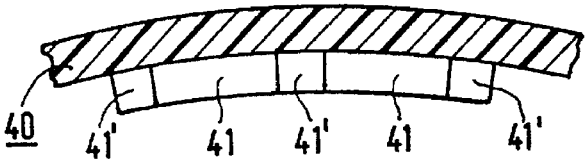
FIG. 3 shows a detail in a cross-section taken on the line III—III in FIG. 2.

The ring 30 has one or several edge portions 32 extending obliquely outwards away from the lamp cap 50 around the annular zone 31, which edge portion cooperate with one or several thickened portions 41 projecting inwards of the housing 40. In the embodiment shown, the housing 40 has six such thickened portions 41 projecting inwards, distributed regularly over the circumference. The thickened portions 41 each have three sloping ridges 41'. Part of the housing 40 with one thickened portion 41 is shown in detail in FIG. 3.

The edge portion 32 of the ring 30 here is a further annular zone which merges via a transition zone 33 into the annular zone 31 mentioned earlier. The annular zone 31, the transition zone 33, and the further annular zone 32 together form a duct in which the end portion 21 of the outer envelope 20 is accommodated.

Figure 4:
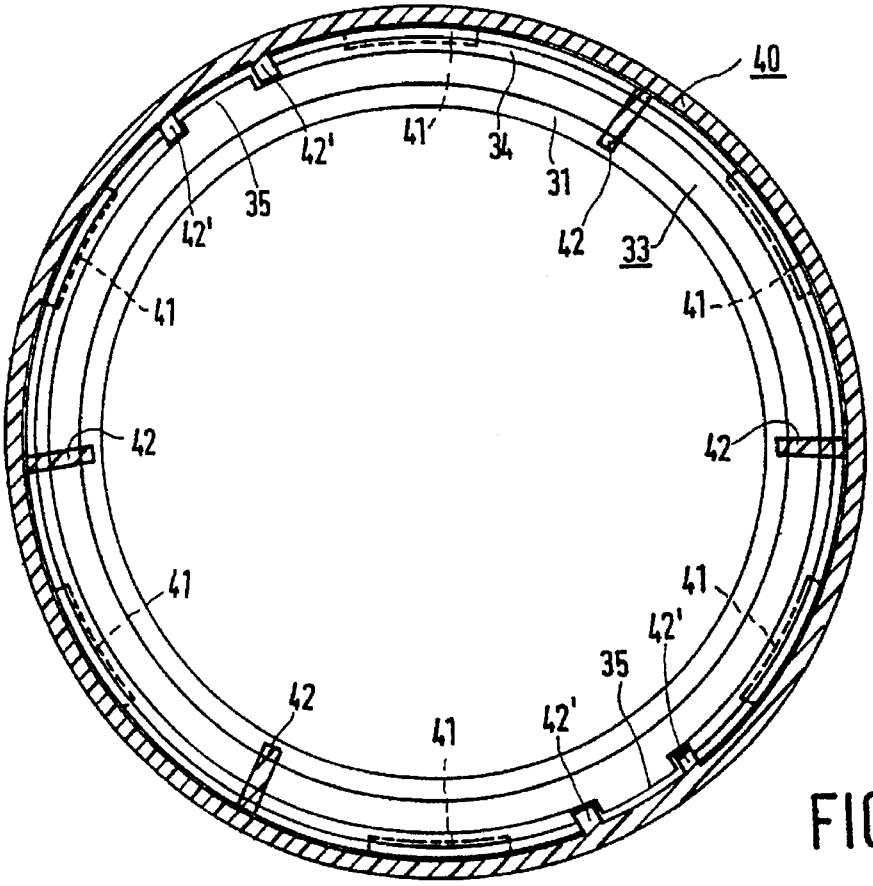
FIG. 4 shows a cross-section taken on the line IV—IV in FIG. 1.

The transition zone 33 has a groove 34 at its circumference in which one or several, here two interruptions 35 are provided (see FIG. 4). The ring 30 bears on seats 42, 42' of the housing 40. The seats 42' in addition cooperate with interruptions 35 of the groove 34 so as to fix the outer envelope 20 tangentially relative to the housing 40.

The outer envelope 20 may be fastened to the ring 30 in the following manner during manufacture of the lamp shown. First the outer envelope 20 is preheated. Then the ring 30 is placed adjacent the end portion 21 of the outer envelope 20, whereupon the end portion 21 is pressed against the annular zone 31 of the ring 30 by a tool. Subsequently, the end portion 21 of the outer envelope 20 is heated further until the glass thereof flows out over the annular zone 31. After the outer envelope 20 has cooled down sufficiently, it can be assembled with the housing 40 in that the ring 30 is pressed into the housing until the edge portion 32 of the ring 30 has passed the inwardly projecting thickened portions 41 of the housing 40. The sloping ridges 41' of the thickened portions 41 facilitate this assembling operation.

I claim:

1. A capped electric lamp comprising a lamp vessel (10) which is closed in a gastight manner, encloses a light source, and is surrounded by a glass outer envelope (20) which at an end portion (21) is fastened to a housing (40) by means of a coupling member (30), which housing also supports a lamp cap (50), characterized in that the coupling member (30) is made of metal, and the end portion (21) of the outer envelope (20) is fused to the coupling member (30).

2. A capped electric lamp as claimed in claim 1, characterized in that the coupling member (30) is a ring.

3. A capped electric lamp as claimed in claim 2, characterized in that the end portion (21) of the outer envelope (20) is fused to an annular zone (31) of the ring (30), which annular zone widens in a direction away from the outer envelope (20) to the lamp cap (50).

4. A capped electric lamp as claimed in claim 3, characterized in that the ring (30) has one or several edge portions (32) around the annular zone (31) which extend obliquely outwards away from the lamp cap (50) and which cooperate with one or several thickened portions (41) of the housing (40) which project inwards.

* * * * *